US011384562B2

(12) United States Patent
Bucarizza

(10) Patent No.: US 11,384,562 B2
(45) Date of Patent: Jul. 12, 2022

(54) SHAPED FENCE

(71) Applicant: COCHRANE GULF FZE, Dubai (AE)

(72) Inventor: Vlado Bucarizza, Dubai (AE)

(73) Assignee: COCHRANE GULF FZE, Dubai (AE)

( * ) Notice: Subject to any disclaimer, the term of this patent is extended or adjusted under 35 U.S.C. 154(b) by 151 days.

(21) Appl. No.: 16/870,385

(22) Filed: May 8, 2020

(65) Prior Publication Data

US 2020/0362588 A1 Nov. 19, 2020

(30) Foreign Application Priority Data

May 16, 2019 (ZA) ..... 2019/02404

(51) Int. Cl.
*E04H 17/16* (2006.01)

(52) U.S. Cl.
CPC ..... *E04H 17/168* (2013.01)

(58) Field of Classification Search
CPC ..... E04H 17/003; E04H 17/14; E04H 17/16; E04H 17/161; E04H 17/165; E04H 17/185; E04H 17/24
See application file for complete search history.

(56) References Cited

U.S. PATENT DOCUMENTS 2,019,379 A * 10/1935 Anderson ..... E06B 9/15 160/235
3,481,094 A * 12/1969 Taylor ..... E04F 13/12 52/394
4,905,970 A * 3/1990 Holmsten ..... A63C 19/10 256/24
5,379,564 A * 1/1995 Wynne ..... E04H 17/161 160/379
10,794,112 B2 * 10/2020 Lambridis ..... E06B 9/70

FOREIGN PATENT DOCUMENTS

CA 2503533 A1 * 10/2006 ..... E04H 17/168
DE 1906926 A1 * 9/1970 ..... E04H 17/161
DE 3309542 A1 * 12/1983 ..... E04H 17/161
FR 489473 A * 2/1919 ..... E04H 17/24
GB 2365032 A * 2/2002 ..... A01K 1/0005
GB 2396165 A * 6/2004 ..... E04H 17/16

OTHER PUBLICATIONS

SportsPlay Equipment, Inc., 2003, "551-421 Baseball Backstop with Hood", SportsPlayinc.com, [online], Archived from Feb. 17, 2009 @ https://web.archive.org/web/20090217001658/https://www.sportsplayinc.com/product_category_sub.php?category=63.*
L.E. Fence Co., 2017, "Water Gap Fencing Solutions", LEFence.com, [online], Available from: https://web.archive.org/web/20170824120349/http:/www.lefence.com/services/water-gaps/ Archived Aug. 24, 2017.*

* cited by examiner

*Primary Examiner* — Jonathan P Masinick
(74) *Attorney, Agent, or Firm* — Tutunjian & Bitetto, P.C.

(57) ABSTRACT

An infill fence panel having a body which made from a mesh material and which has a first edge and a second edge opposing the first edge. The second edge forms an included acute angle with the first edge such that the body, from one side, has a wedge shape. The first edge is located on, and is fixed to, an upper edge of a primary panel which is of rectangular form and made from a mesh material.

4 Claims, 3 Drawing Sheets

SHAPED FENCE

BACKGROUND OF THE INVENTION

This invention relates to the construction of a fence.

One type of fence is made from a plurality of rectangular mesh panels. Each panel is positioned between and fixed to a pair of adjacent, and spaced apart, fence posts which lie on a fence line which defines a perimeter. The fence line follows the contours of the ground in which the posts are planted. If the ground surface between an adjacent pair of posts is fairly level (horizontal) then, when a fence panel is fixed to the pair of posts, a lower edge of the panel is more or less in ground contact and an upper edge of the panel has an effective height above ground which is equal to the height of the panel. If the ground traversed by the fence line slopes, then between an adjacent pair of posts, the ground surface will be inclined from one post to the other. It is then necessary to "step" the associated panel so that its lowest edge which normally is adjacent one of the posts, is at a highest point on the ground between the adjacent posts.

A fence erected in the aforementioned manner, over uneven ground, consequently has an upper profile which is stepped to follow the contours of the ground below even though the ground below may have a surface which varies gradually in its inclination.

The stepped upper edges of the panels may have an appearance which is aesthetically unappealing. Of more consequence is that, if the fence is designed as a security barrier, the variation in the effective height of the fence may make it easier for an intruder to climb over the fence. For example, with a steep ground gradient it then becomes necessary to plant the posts closer together, and to use panels of a reduced width. This calls for the use of additional posts and the demand for concrete to anchor the posts in the ground is increased.

An object of the present invention is to address, at least to some extent, the aforementioned situation.

SUMMARY OF THE INVENTION

The invention provides an infill fence panel which includes a body made from a mesh material, and from one side has a wedge shape.

The body may have a first edge and a second edge which opposes the first edge, and which forms an included acute angle with the first edge.

The size of the included acute angle may vary according to requirement.

The infill fence panel may be provided in a plurality of standard sizes so that, within reason, a selected panel will have an included acute angle which is more or less the same as the slope of the ground at which the infill panel is to be used.

The body of the infill panel may have a third edge which is at a right angle to the first edge and a fourth edge which is shorter in length than the third edge.

If the length of the first edge is A and the length of the third edge is B then $B/A \leq 1/8$.

By way of example only the infill panel may have a length (i.e. the length of the first edge) of the order of 3 meters. The length of the third edge which effectively is the maximum height of the infill panel when it is used may be selected from 50 mm, 100 mm, 200 mm, 300 mm and 400 mm. The aforementioned dimensions mean that, by way of example, $B/A = 1/60$ or $1/30$ or $1/15$ or $1/10$ or approximately. It is desirable to provide the infill panels in sets, with the panels in each set having different B/A ratios, so that a technician in the field, erecting a fence can, on site, choose an infill panel to suit the ground contour at the site.

The first edge may be formed with a flange which extends generally transversely to a plane in which a substantial part of the body lies. The flange may be more or less at a right angle to this plane. The purpose of the flange is to provide a means whereby the body of the infill panel can be attached, with relative ease, to an upper edge of a lower or underlying rectangular fence panel.

The second edge of the body may also be formed with a flange or other stiffening structure.

The invention also extends to a fence which includes a plurality of primary panels each of which is of rectangular form and is made from a mesh material, and a plurality of fence posts which are planted in the ground spaced apart from each other along a fence line, wherein each primary panel is located between and secured to a respective pair of adjacent fence posts, and at least one infill panel, of the aforementioned kind, and wherein the first edge of the infill panel is located on, and fixed to, an upper edge of a primary panel.

The use of the infill panel thus enables a fence to be erected wherein an upper edge of the fence more or less follows the underlying ground contour. It is also possible to use an infill panel, generally of the kind referred to, at a lower edge of a primary panel so that the infill panel can effectively close a gap between a lower edge of the primary panel and an opposing ground surface which is inclined relative to the lower edge i.e. to the horizontal.

BRIEF DESCRIPTION OF THE DRAWINGS

The invention is further described by way of example with reference to the accompanying drawings in which.

DESCRIPTION OF PREFERRED EMBODIMENT

Figure 1:
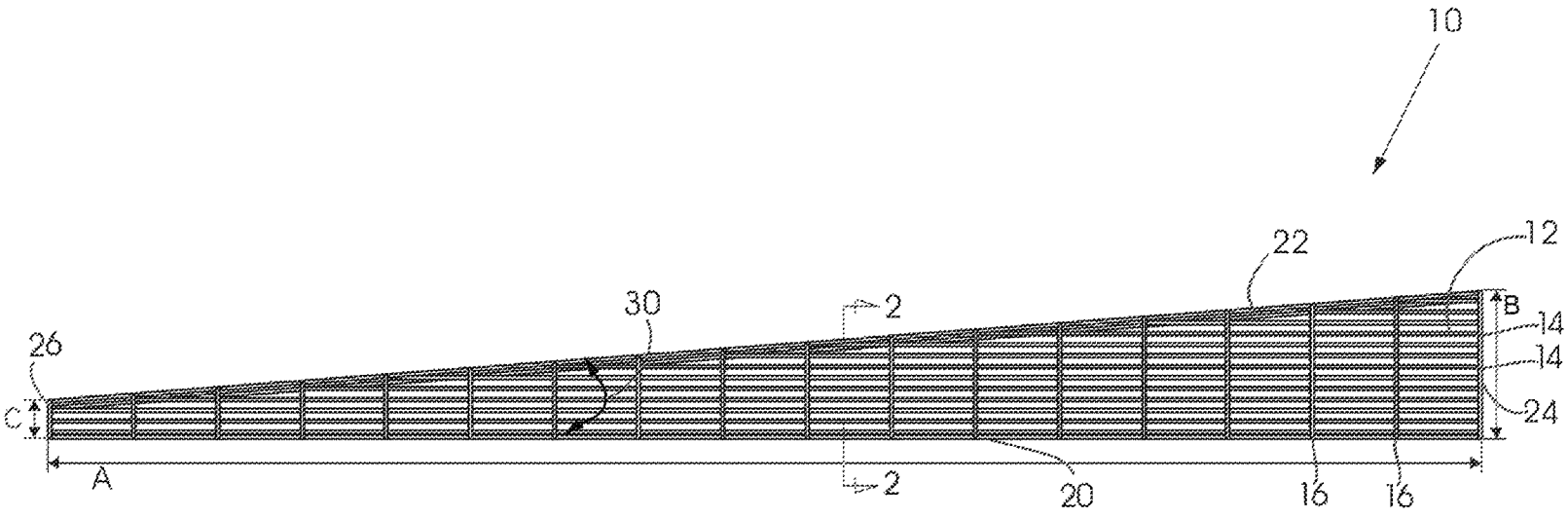
FIG. 1 is a side view of an infill panel according to one form of the invention.

FIG. 1 of the accompanying drawings is a side view of an infill panel 10 according to one form of the invention.

The infill panel 10 has a body 12 which is made from a mesh material formed from a plurality of closely packed, horizontally extending, parallel and spaced apart wires 14 welded to a plurality of transversely extending, parallel and spaced apart vertical wires 16 which are less densely packed than the wires 14.

The infill panel 10, viewed from the side, has a wedge shape. The body 12 of the infill panel includes a first edge 20, a second edge 22, a third edge 24 and a fourth edge 26.

The second edge 22 opposes the first edge 20 and is inclined relative thereto in that the two edges 20 and 22 define an included angle 30 between them. The first edge 20 has a length A. Due to the inclination of the second edge 22 relative to the first edge, the second edge is longer than the dimension A. The third edge 24 has a length B and is more or less at a right angle to the first edge 20. The fourth edge 26 has a length C, in a direction which is transverse to the first edge 20, which is of minimal value.

The size of the included angle 30 is dependent on the ratio B/A. If A is of the order of 3 meters, i.e. if the infill panel 10 has a standard width of 3 meters then B may, according to the requirement, be selected from a range of standard lengths namely 50 mm, 100 mm, 200 mm, 300 mm, and 400 mm. These dimensions give corresponding ratios of B/A=1/60 or 1/30 or 1/15 or 1/10 or approximately 1/8. All these values are exemplary only and are non-limiting. Nonetheless, these values are preferred values which have been identified through use and experimentation to be suitable in most instances for addressing the problems referred to in the preamble of this specification. In this regard it is preferable to manufacture sets of infill panels, complying with these ratios so that during erection of a fence suitable infill panels can be selected according to the terrain.

Figure 2:
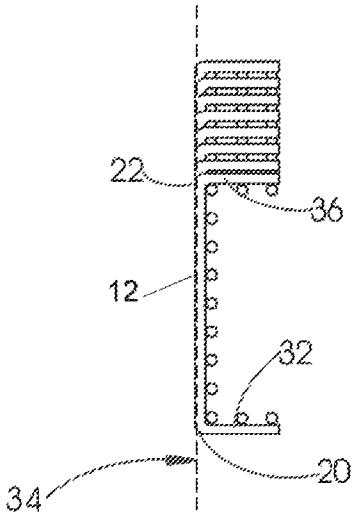
FIG. 2 is a cross sectional view of the infill panel taken long line 2-2 in FIG. 1.

FIG. 2 illustrates the infill panel 10 in cross-section taken on a line 2-2 in FIG. 1. An inspection of FIG. 2 shows that the first edge 20 is formed with a flange 32 which extends transversely to a plane 34 in which most of the body 12 of the infill panel 10 lies. A flange or a stiffening formation 36, of any appropriate kind, is formed at the second edge 22.

Figure 3:
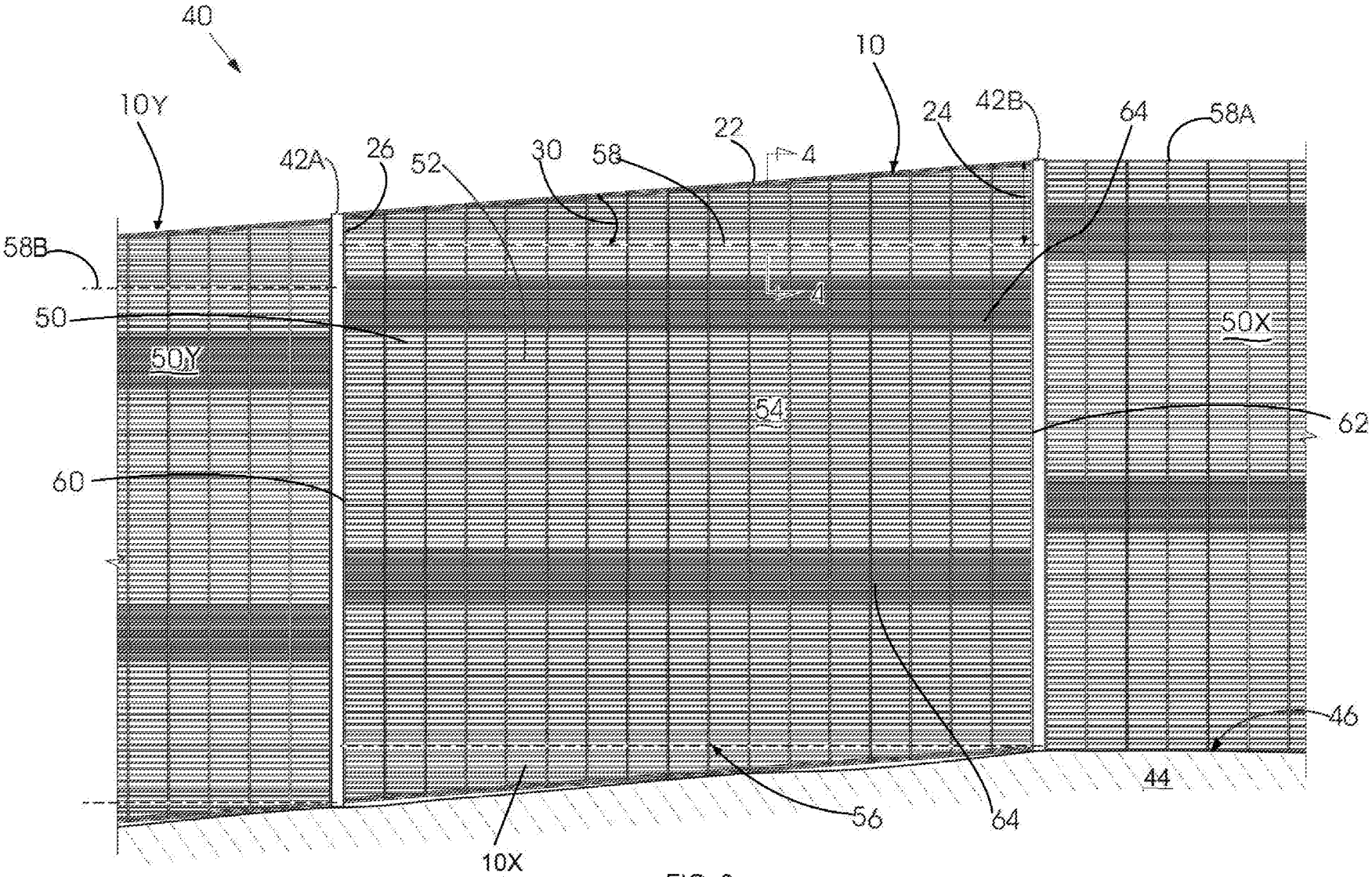
FIG. 3 is a side view of a section of a fence which includes a primary panel and an infill panel.

FIG. 3 illustrates from one side a section of a fence 40 which incorporates an infill panel 10 of the kind shown in FIG. 1. The fence 40 includes a plurality of fence posts 42A, 42B etc which are positioned spaced apart from one another along a fence line and which have lower ends embedded in underlying ground 44. The ground surface 46 between the posts 42A and 42B is uneven and, in this example, the surface 46 rises from the post 42A towards the post 42B.

A primary fence panel 50 is located between and secured to the fence posts 42A and 42B. The primary fence panel 50 is made from a mesh material 52 which is similar to that used in the infill panel 10. The primary fence panel 50 has a body 54 which is of rectangular outline and which has a lower edge 56 (shown by a dotted line), an upper edge 58 (shown by a dotted line) and opposed vertically extending edges 60 and 62 respectively.

The body 54 may be strengthened or stiffened in any appropriate way through the use of rigidifying members (not shown), or by ridges in the form of V-shaped channels (shown as darkened zoned 64) or the like in the mesh material 52. The invention is not limited in this way.

The post 42B extends higher than the post 42A due to the rise in elevation of the ground surface 46 moving from the left to the right in FIG. 3. A second primary fence panel 50X is attached to the post 42B. Normally, an upper edge 58A of the panel 50X is aligned with an upper end of the post 42B. A third primary panel 50Y is attached to the post 42A. Depending on the slope of the ground surface 46 an upper edge 58B of the panel 50Y is displaced from an upper end of the post 42A. The primary panels 50Y, 50 and 50X are thus "stepped" to follow the contour of the ground surface 46.

To overcome the "stepping" appearance, an infill panel 10 is positioned on top of the upper edge 58 of the primary panel 50. The included angle 30 of the infill panel is such that, within reason, the third edge 24 of the infill panel is more or less equal in length to the spacing between the upper edge 58 of the primary panel 50 and an upper end of the post 42B. At the left side, the fourth edge 26 of the infill panel is of minimal height. The second edge 22 of the infill panel thus provides a smooth transition from the upper end of the post 42A to the upper end of the post 42B, more or less parallel to the contour of the ground surface 46 between the posts 42A and 42B. According to the slope of the ground, on the left of the post 42A, another infill panel 10Y can be employed in a similar manner to the infill panel 10. If the ground on the right of the post 42B is more or less level then an infill panel would not be called for. At the right side in FIG. 3 the infill panel 10 is secured to the fence post 42B and, at the left side, the fourth edge 26 is secured using any suitable fastener, not shown, to the post 42A.

Figure 4:
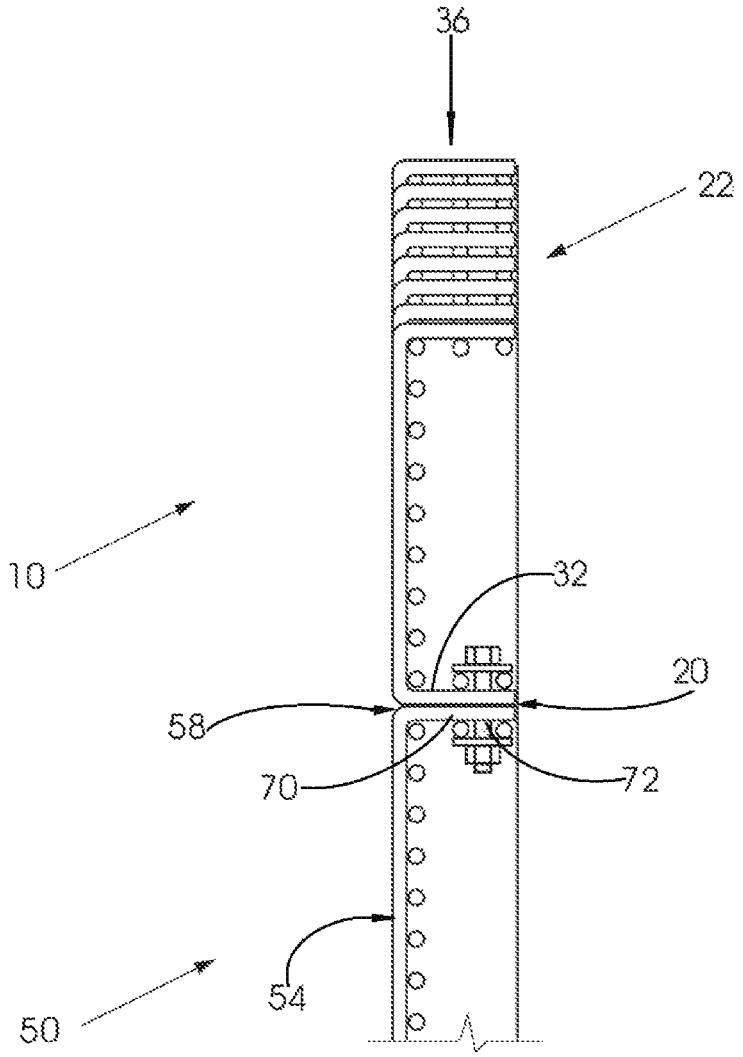
FIG. 4 is a cross sectional view taken along line 4-4 in FIG. 3.

FIG. 4 shows in cross-section taken on a line 4-4 in FIG. 3 the infill panel 10 and an upper portion of the primary panel 50.

The primary panel along the upper edge 58 carries a stiffening member or is formed with a stiffening flange 70 which is more or less at a right angle to a plane in which the body 54 lies. The infill panel 10 is positioned so that the flange 32 at its first edge 20 lies squarely on the flange 70. Fasteners 72 of any appropriate kind are then used to secure the flange 32 to the flange 70.

The second edge 22 of the infill panel 10 is stiffened by means of the formation 36.

According to the slope of the ground surface an appropriate infill panel is selected and then used so that the fence 40 has an upper edge which closely follows the contour of the underlying ground surface 46. The upper edge of the erected fence 40 has a more aesthetically satisfying appearance and, additionally, due to the elimination of the steps, the security value of the erected fence is not reduced in that the fence does not have one or more regions of reduced height which would allow an intruder to scale the fence more readily.

The aforementioned principles can also be applied, if necessary, to the lower edge 56 of a primary fence panel 50 as is shown in FIG. 3. A wedge-shaped infill panel 10X which is selected taking into account the ground contour, can be fixed to the lower edge 56 to facilitate the closure of a gap at the lower edge.

What is claimed is:

1. An infill fence panel comprising a body made from a mesh material and having a first edge and a second opposing edge forming an included acute angle with the first edge, and a third edge at a right angle to the first edge such that the body, from one side, has a wedge shape;

wherein the first edge is formed with a flange extending substantially transversely to a plane in which a substantial part of the body lies and which flange is at a right angle to this plane, and the second edge of the body is formed with a stiffening flange.

2. A fence comprising:

a plurality of primary panels each of which is of rectangular form and is made from a mesh material and includes an upper horizontal edge and a lower horizontal edge parallel to the upper horizontal edge, a plurality of fence posts planted in the ground spaced apart from each other along a fence line, wherein each of the plurality of primary panels is located between and secured to a respective pair of adjacent fence posts, and at least one infill panel according to claim 1, wherein the first edge of the infill panel is located on, and is fixed to, the upper horizontal edge of a primary panel among the plurality of primary panels.

3. The fence according to claim 2, further comprising an additional infill panel located adjacent, and fixed to, the lower horizontal edge of at least one of said plurality of primary panels, to close a gap between the lower horizontal edge and an opposing ground surface.

4. A set of infill panels, each infill panel being according to claim 1, wherein, for each infill panel the length of the first edge is A and the length of the third edge is B and wherein $B/A<1/8$.

* * * * *